US008590441B1

(12) United States Patent
Good et al.

(10) Patent No.: US 8,590,441 B1
(45) Date of Patent: Nov. 26, 2013

(54) SEARCHLIGHT SYSTEM

(76) Inventors: Ken J. Good, San Diego, CA (US); Rob Klidy, San Marcos, CA (US)

( * ) Notice: Subject to any disclaimer, the term of this patent is extended or adjusted under 35 U.S.C. 154(b) by 134 days.

(21) Appl. No.: 12/732,372

(22) Filed: Mar. 26, 2010

Related U.S. Application Data

(60) Provisional application No. 61/163,769, filed on Mar. 26, 2009.

(51) Int. Cl.
*F41G 3/16* (2006.01)

(52) U.S. Cl.
USPC ..... 89/41.22; 42/146

(58) Field of Classification Search
USPC ..... 42/146; 89/41.22
See application file for complete search history.

(56) References Cited

U.S. PATENT DOCUMENTS

| | | | | |
|---|---|---|---|---|
| 2,597,565 | A * | 5/1952 | Chandler et al. | 362/110 |
| 5,913,669 | A * | 6/1999 | Hansen et al. | 42/146 |
| 8,141,290 | B2 * | 3/2012 | LaFrance et al. | 42/90 |
| 2006/0288626 | A1 | 12/2006 | Kim | |

OTHER PUBLICATIONS

Michael Jones, Miniature Day/Night Sight Crews Served Weapons, NDIA Small Arms Symposium, May 8, 2007.

* cited by examiner

*Primary Examiner* — Stephen M Johnson
(74) *Attorney, Agent, or Firm* — MDIP LLC

(57) ABSTRACT

A weapons system having a searchlight is disclosed, the weapons system having a gun, a gun mounting system configured to removably hold the gun, the gun mounting system having vibration/shock isolation portion, a cantilever mount having a first end configured to attach to the vibration/shock isolation portion of the gun mounting system opposite the gun, a light mount configured to attach near a second end of the cantilever mount, and a searchlight removably attached to the light mount.

17 Claims, 14 Drawing Sheets

SEARCHLIGHT SYSTEM

CROSS REFERENCE TO RELATED APPLICATION

This application claims benefit to U.S. Provisional Application No. 61/163,769, filed Mar. 26, 2009, under 35 U.S.C. §119(e), the contents of which are incorporated in their entirety herein.

BACKGROUND OF THE INVENTION

1. Field of the Invention

The present invention relates generally to a weapons system having optical augmentation, and more particularly, to a searchlight system that takes advantage of shock buffers within the weapons system to reduce/eliminate the effects of the weapons system recoil on the functionality of optical augmentation.

2. Background Information

As opponent weapons range increases, enhanced target acquisition is becoming more critical to ensure special operation force (SOF) success during engagements. Thus, there is a need to improve the operational effectiveness of the family of SOF crew-service weapons, including weapon mounting devices, by developing modular systems that improve target recognition, enhance target acquisition, maximize hit probability during day and night operations, provide visual signature suppression, and increase the probability of engagements out to the maximum range of basic weapons during all types of operations and environmental conditions.

One of these developments involves enhancements to optical augmentation systems designed to increase SOF target engagement capability with crew-service weapons in low-light/low observation situations. Prior art systems affix light directly to the weapons systems themselves, or attach light systems to a protective shield that might be in front of the cradle/gunner, which is also attached directly to the weapons system. This direct attachment allows the light to move/vibrate with the recoil of the weapons system when in use (see, e.g., US. Pub. No. 2006/0288626). The movement or vibration of the light may be distracting to the gunner, and may also reduce the service life of the light itself.

To optimize crew-service operational capabilities of the 40 mm MK19 Grenade Machine Gun (GMG) and the .50 caliber/12.7 mm M2 Heavy Machine Gun (HMG), the US military developed the MK93 Heavy Machine Gun Mounting System (hereinafter the MK93). The MK93 is a dual purpose, soft mount used to lessen the recoil of heavy weapons like the MK19 and M2. The use of a soft mount improves the accuracy of the M2 Machine Gun by attenuating the recoil. The MK93 attaches to a tripod for infantry use, but has seen much more frequent use as part of a vehicular mount, using the MK175 pintle pedestal. The MK93 requires no external adapters or tools to mount either weapon system, making change-overs much easier, and consists of a gun carriage and cradle assembly, a train stop bracket, an ammunition can holder, a bolt-on small pintle, a bolt-on large pintle, and a stowage bar assembly.

The MK93 gun mounting system improves the accuracy of the HMG or GMG by attenuating the recoil using shock buffers. However, as will be disclosed in more detail below, there is a particular need for a robust, secure manner in which to provide a lighting system that reduces and/or eliminates the effects of the weapons system recoil on the functionality of optical augmentation.

SUMMARY OF THE INVENTION

The present invention describes a searchlight system that affixes to a MK93 by taking advantage of two high strength bolts previously used exclusively to secure the two parallel shock buffers within the cradle itself. The cantilever mount of the system has unique advantages over the current methodology of affixing mounting brackets to the weapon systems themselves or attempting to attach a mount/bracket to a protective shield that might be in front of the cradle/gunner.

In a first aspect, embodiments of the present invention provide a weapons system having a searchlight, the weapons system includes a gun, a gun mounting system configured to removably hold the gun, the gun mounting system having a vibration/shock isolation portion, a cantilever mount having a first end configured to attach to the vibration/shock isolation portion of the gun mounting system opposite the gun, where the cantilever mount includes at least one bend therein defining a reflex angle relative to the longitudinal plane of the vibration/shock isolation portion, a substantially tubular light mount configured to attach near a second end of the cantilever mount, and a searchlight removably attached to the light mount, where the substantially tubular light mount encircles the searchlight.

In one aspect, the substantially tubular light mount is formed by a top assembly hingedly connected to a base assembly. In another aspect, an outside surface of the substantially tubular light mount includes a toggle latch-clamp assembly configured to oppose a hinged connection between the top assembly and the base assembly, where the toggle-latch clamp assembly comprises a push-pull pin engaged therein configured to securely clasp the searchlight.

In another aspect, an outer surface of the top assembly includes at least one rail affixed along an apex substantially orthogonal relative to a hinged connection. In a related aspect, the base assembly includes an integral block portion having a substantially flat top surface or having a substantially flat top surface and a central longitudinally oriented raised mounting structure thereon configured to engage an accessory or the cantilever mount. In a further related aspect, the accessory includes at least one riser mount coupled at a first end to the raised mounting structure. In another related aspect, the riser mount is a riser mount-center or a riser mount-side.

In one aspect, the raised mounting structure is coupled to a rail grabber assembly or a dual-throw lever base mount. In a related aspect, a rail grabber assembly or a dual-throw lever base mount is coupled to a second end of the at least one riser mount. In a further related aspect, the second end of the cantilever mount is coupled to a second end of the at least one riser mount.

In another aspect, a portion of the second end of the cantilever mount has a substantially flat bottom surface configured to engage the top assembly of the substantially tubular light mount or has a substantially flat bottom surface and a central longitudinally oriented raised mounting structure thereon configured to engage an accessory.

In one aspect, the first end of the cantilever mount contacts a vibration buffer disposed between the first end of the cantilever mount and the vibration/shock isolation portion. In another aspect, the second end of the cantilever mount contacts a vibration buffer disposed between the second end of the cantilever mount and the substantially tubular light mount.

In another aspect, the gun is selected from a M2 Heavy Machine Gun (HMG) or a MK19 Grenade Machine Gun. In a related aspect, the gun mounting system is a MK93 gun mounting system. In a further related aspect, the searchlight is a high intensity discharge searchlight.

In one aspect, the searchlight includes a substantially circular cover assembly at a light-discharging end of the searchlight, which cover assembly includes, in hinged connection, a protective outer lid, a separate middle lens-containing frame and a separate base, where the separate base is adapted to engage the light-discharging end, and where the lid and middle frame are adapted to separately pivot to and away from the base through a first hinge. In a related aspect, the lens is IR filter glass.

In one aspect, the lens is protected by securing the lid against the middle frame via one or more magnets. In another aspect, the lid or middle frame is separately secured to or away from the base via one or more push-pull pins anchored through a second hinge.

In another embodiment, a searchlight system is disclosed including a cantilever mount having a first end configured to attach to a vibration/shock isolation portion of a gun mounting system, where the cantilever mount includes at least one bend therein defining a reflex angle relative to the longitudinal plane of the vibration/shock isolation portion, a substantially tubular light mount configured to attach near a second end of the cantilever mount, and a searchlight removably attached within a cavity formed inside the substantially tubular light mount.

In a related aspect, the cavity is formed by a top assembly hingedly connected to a base assembly, whereby the top assembly and base assembly encircle the searchlight.

In one embodiment, a method of attaching a searchlight system to a gun mounting system is disclosed including securing a first end of a cantilever mount in a preferred alignment with a vibration/shock isolation portion of a gun mounting system, where the cantilever mount includes at least one bend therein defining a reflex angle relative to the longitudinal plane of the vibration/shock isolation portion, securing a substantially tubular light mount to a second end of the cantilever mount, and removably securing a search light within the substantially tubular light mount.

In one aspect, the method includes disposing a first vibration buffer between the first end of the cantilever mount and the vibration/shock isolation portion and disposing a second vibration buffer between the second end of the cantilever mount and the substantially tubular light mount. In another aspect, the method includes securing the searchlight by locking-down a toggle latch-clamp assembly configured to engage a top assembly and a base assembly that form the substantially tubular light mount, where the toggle-latch clamp assembly includes a push-pull pin therein, and when the toggle-latch clamp assembly is locked-down and engaged the searchlight is removably secured within the substantially tubular light mount. In a related aspect, the gun mounting system is a MK93 gun mounting system.

BRIEF DESCRIPTION OF THE DRAWINGS

The foregoing summary, embodiments, and other aspects of the present invention will be best understood with reference to a detailed description of specific embodiments of the invention, which follows, when read in conjunction with the accompanying drawings. In the drawings, closely related figures have the same number.

DETAILED DESCRIPTION OF THE INVENTION

Before the present articles, components, composition, methods, and methodologies are described, it is to be understood that this invention is not limited to particular articles, components, compositions, methods, and conditions described, as such articles, components, methods, and conditions may vary. It is also to be understood that the terminology used herein is for purposes of describing particular embodiments only, and is not intended to be limiting.

As used in this specification and the appended claims, the singular forms "a", "an", and "the" include plural references unless the context clearly dictates otherwise. Thus, for example, references to "a system" includes one or more systems, and/or components of said system of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Any methods and materials similar or equivalent to those described herein can be used in the practice or testing of the invention, as it will be understood that modifications and variations are encompassed within the spirit and scope of the instant disclosure.

The present invention is directed to a searchlight system for use with various weapon or gun mounting systems. One such searchlight system is available from Polarion-USA LLC called a Crew Served Weapon Light (CSWL)—Modular High Intensity Discharge (HID) Searchlight System. The searchlight system uses a unique modular HID searchlight system for the specific purpose of using these types of illumination tools in high threat, battlefield and security environments. The overall system may be designed for deployment in multiple roles and may use a unique mounting hardware and mounting methodologies in order to affix the system to a variety of weapons platforms. The System features interchangeable accessories that can be quickly reconfigured to meet fluid mission requirements.

Figure 1A:
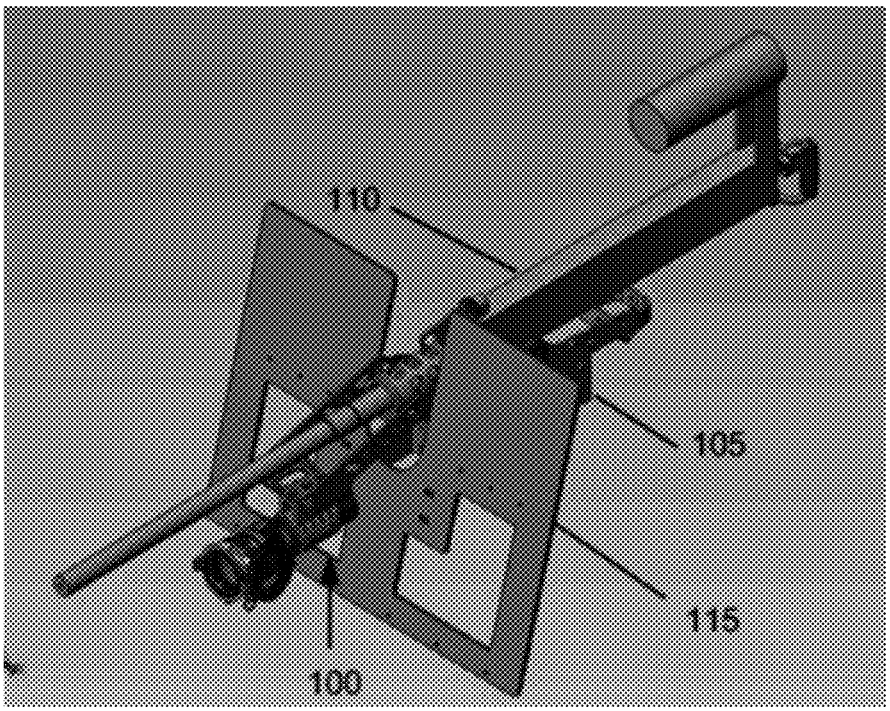
FIG. 1A shows an isometric view of a searchlight system mounted on a gun mounting system.
Figure 1B:
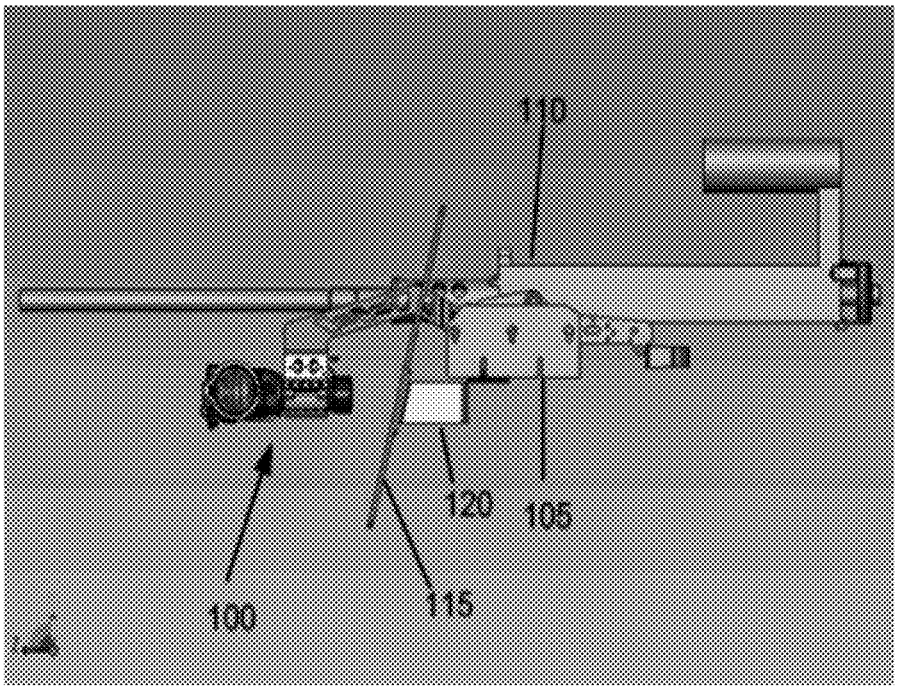
FIG. 1B shows a side view of a searchlight system mounted on a gun mounting system.

As shown in FIGS. 1A and 1B, a searchlight system 100 may be attached to a MK93 gun mounting system 105. The MK93 gun mounting system 105 may be used with a .50 caliber/12.7 mm M2 Heavy Machine Gun (HMG) or a 40 mm MK19 Grenade Machine Gun (GMG) 110. The MK93 gun mounting system 105 may also include a shield 115 and shield bracket 120. The MK93 gun mounting system 105 provides platform stabilization, improves accuracy, and increases hit probability while decreasing the time and effort to install and interchange weapons. During use, the HMG or GMG 110 generates recoil. The MK93 gun mounting system 105 includes features to improve the accuracy of the HMG or GMG 110 by attenuating the recoil using shock buffers. The searchlight system 100 utilizes this multiple stage vibration/shock isolation device to further eliminate the effects of the weapons system recoil on the functionality of the light system. By employing this methodology, the actual HID searchlight itself is subject to much lower direct recoil forces, because the HID searchlight is not directly affixed to the weapon. The design takes advantage of the MK-93 shock buffers to mitigate these forces. Attaching the searchlight system 100 of the present invention to the MK93 gun mounting system 105, instead of directly to the HMG or GMG 110, reduces or eliminates the effects of the weapons system recoil on the functionality of the lighting system.

Figure 2:
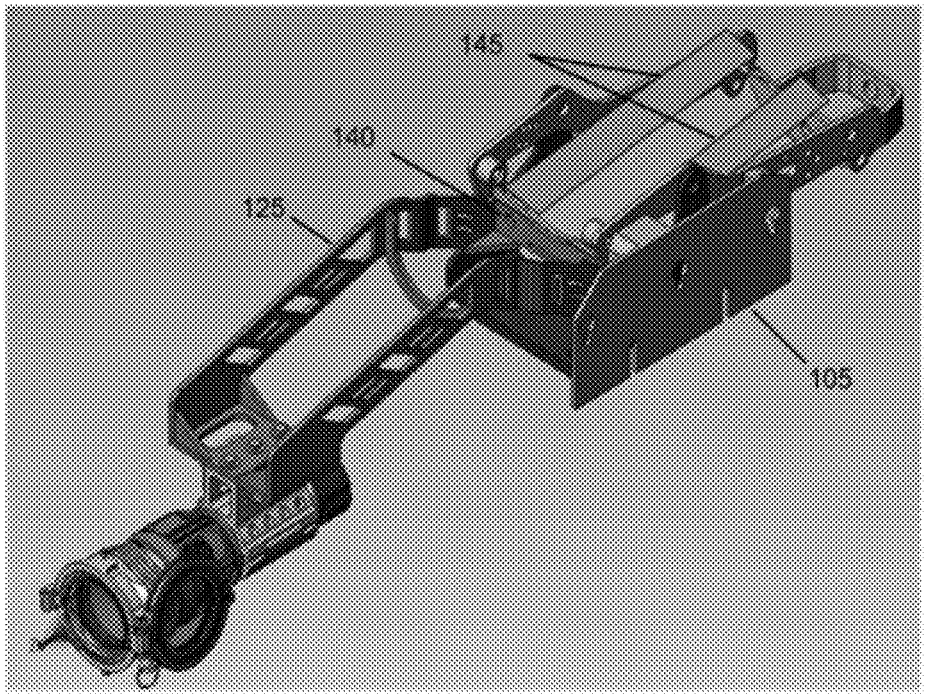
FIG. 2 shows an isometric view of a searchlight system coupled to a gun mounting system.

FIG. 2 shows the searchlight system 100 attached to the MK93 gun mounting system 105. A cantilever mount 125 of the searchlight system 100 attaches to the MK93 gun mounting system 105 at location 140 at the end of the two parallel shock buffers 145 within the MK93 cradle. The attachment is done by removing high strength bolts at location 140 that secures the two parallel shock buffers 145 within the MK93 cradle itself and attaching the cantilever mount 125 to the MK93 cradle with the high strength bolts. By affixing the cantilever mount 125 to these attachment points on the MK93, and not directly the HMG or GMG 110, the searchlight system 100 allows the user to quickly remove the weapon itself without the need to unbolt the searchlight from the weapon, as it is not attached to the weapon utilizing traditional methodologies. This means that a user can also swap the actual type of weapon itself from a M2 Machinegun to a MK-19 Auto Grenade Launcher or any other weapon system that can be affixed to a MK-93 Cradle or the like. For example, the searchlight system 100 may be configured to allow for quick interchange of the standard BFA (blank firing adapter) without removing the bracket/mount from the weapons system.

By utilizing the existing high strength bolts, no modifications are required of the MK93 gun mounting system to use the searchlight system 100. This is an advantage for upgrading current MK93 gun mounting systems with a searchlight system 100 without modification of the MK93 gun mounting systems. The searchlight system 100 may also be provided in a kit for the upgrade.

Figure 3:
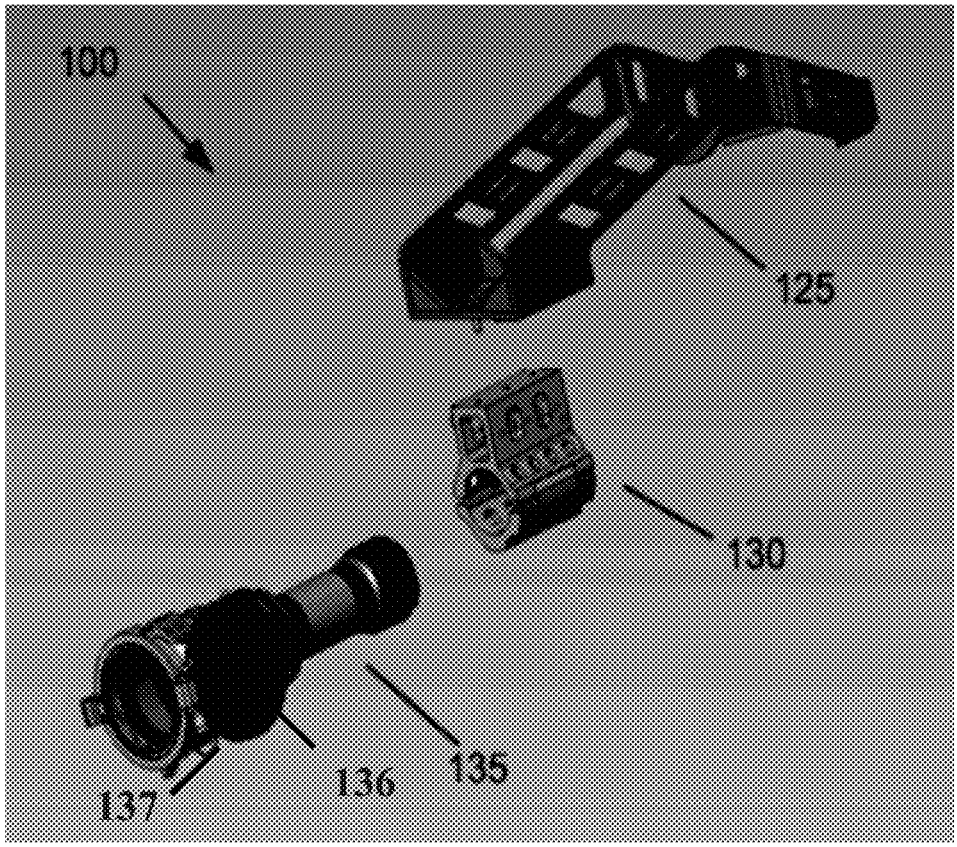
FIG. 3 shows an exploded isometric view of a searchlight system.

FIG. 3 shows an exploded view of the searchlight system 100. The searchlight system 100 includes the cantilever mount 125, a light mount 130 and a searchlight 135. The light mount 130 is attached to the cantilever mount 125 near an end opposite the weapons mount, as shown in FIG. 2. Also shown is a lens-containing frame 136 for the disposition of a filter, for example, but not limited to, an infrared (IR) filter (frame 136 is shown pivoted away from the light-discharging end of the searchlight 135), including a push-pull pin 137 which anchors the frame 136 in any selected position. The cantilever mount and light mount may be made of many different materials, such as aluminum, steel, composites, or other suitable materials. The high intensity discharge (HID) searchlight may be any suitable searchlight having an internal battery and/or powered by an external power source.

In one embodiment, the light mount 130 includes quick disconnect camming levers that allow soldiers to rapidly remove the searchlight 135 itself from the light mount 130 to employ the searchlight 135 in a "boot on the ground" handheld search modality. In other words, the searchlight 135 can quickly go from the weapon to a handheld configuration and back again in a matter of seconds. Utilizing the internal battery configuration, the user is not required to bring any power source, additional switches or cables to operate the searchlight 135 when searching for threats.

In another embodiment, the searchlight system 100 of FIG. 3 may also be provided as a kit for upgrading gun mounting systems in the field with searchlight capability. The kit comprises a cantilever mount 125, a light mount 130 and a searchlight 135. As discussed above, the cantilevered mount has a first end configured to attach to a vibration/shock isolation portion of a MK93 gun mounting system or the like. The searchlight mount may be configured to attach near a second end of the cantilevered mount and the searchlight may be configured to be removably attached to the searchlight mount.

Figure 4:
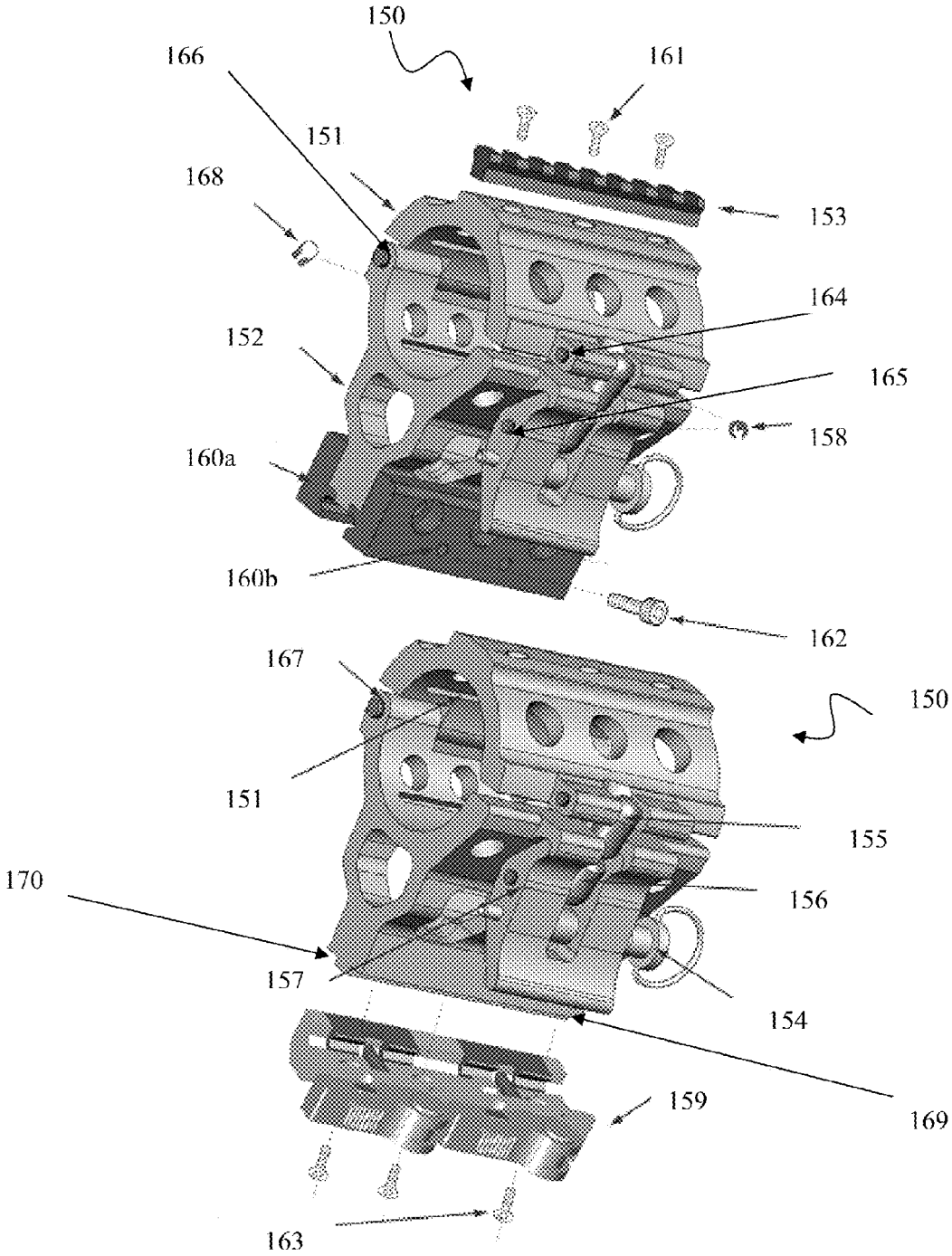
FIG. 4 shows an isometric view of the light mount.

A detailed view of a camming lever embodiment of the light mount 150 is shown in FIG. 4. The light mount 150 has a toggle-latch clamp assembly 157, including a push-pull pin 154, female threaded pin 155, and male threaded pin 156. The pins 155,156 are secured to the top 151 and base 152 assemblies by separate bolts 164,165, where the bolts 164,165 are secured to the assemblies through e-clip clips 158 or the like. As shown in FIG. 4, the toggle-latch clamp assembly 157 is in the locked down position. As stated above, the toggle-latch clamp assembly affords quick, secure, and facile engagement and disengagement of the search light with the light mount.

The top assembly 151 is configured to receive a rail 153, for example, but not limited a Picatinny rail, on a raised surface, where the rail 153 is orthogonal relative to a hinge 166 which connects the top assembly 151 to the base assembly 152. The hinge 166 is secured through a bolt 167 and retaining clip 168. The rail 153 is secured to the top assembly 151 through, for example, low profile socket head cap screws 161 or the like, as will be apparent to one of skill in the art. The rail assembly allows for coupling with the cantilever mount or other accessories.

Also shown in FIG. 4 is the base assembly 152 having a substantially flat top surface 169 and a central longitudinally oriented raised mounting structure 170 thereon. The mounting structure 170 may be coupled to a rail grabber assembly 160*a*,160*b* (i.e., a clearance rail grabber 160*a* and a threaded rail grabber 160*b*), which is secured using, for example, one or more socket head cap screws 162. Alternatively, the mounting surface 170 may be coupled to a dual-throw lever base mount 159 (e.g., available from Global Defense Initiatives (GDI) Inc., Temecula, Calif.), which is secured to the base assembly 152 through, for example, low profile socket head cap screws 163. The rail grabber assembly and dual-throw level base mount provide alternative mounting platforms to further expand accessorization of the light mount.

Figure 5:
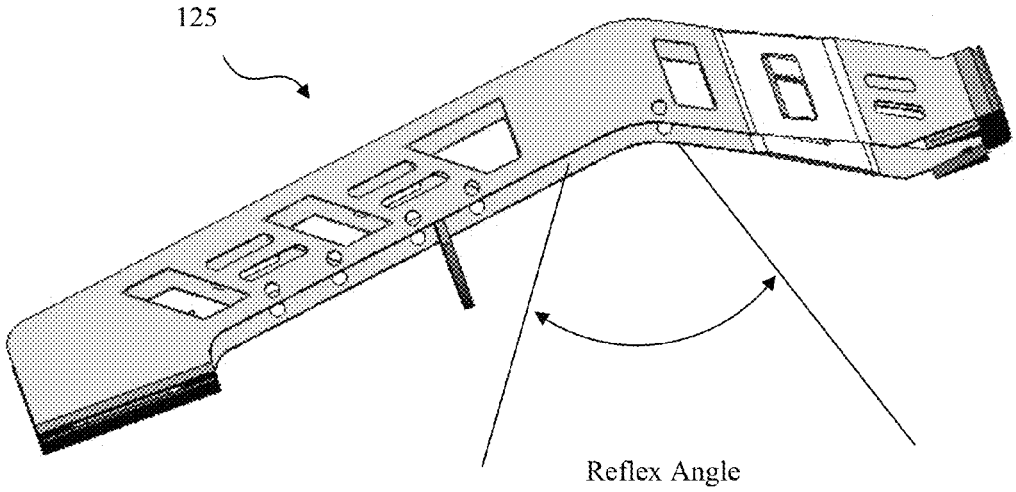
FIG. 5 shows an isometric view of the cantilever (side).

FIG. 5 shows the cantilever mount 125, with emphasis of the reflex-angled bend contained therein. The shape and angling of the cantilever design ensures that the operator has full down-deflection of his or her weapons system. A straight design would lead to impinging of the mount against the protective shield 115 (FIG. 1). Such a straight design degrades the overall engagement envelope of the weapons system simply because the gun 110 (FIG. 1) is impeded from achieving its full range of motion (i.e., stopped from going all the way down).

Figure 6:
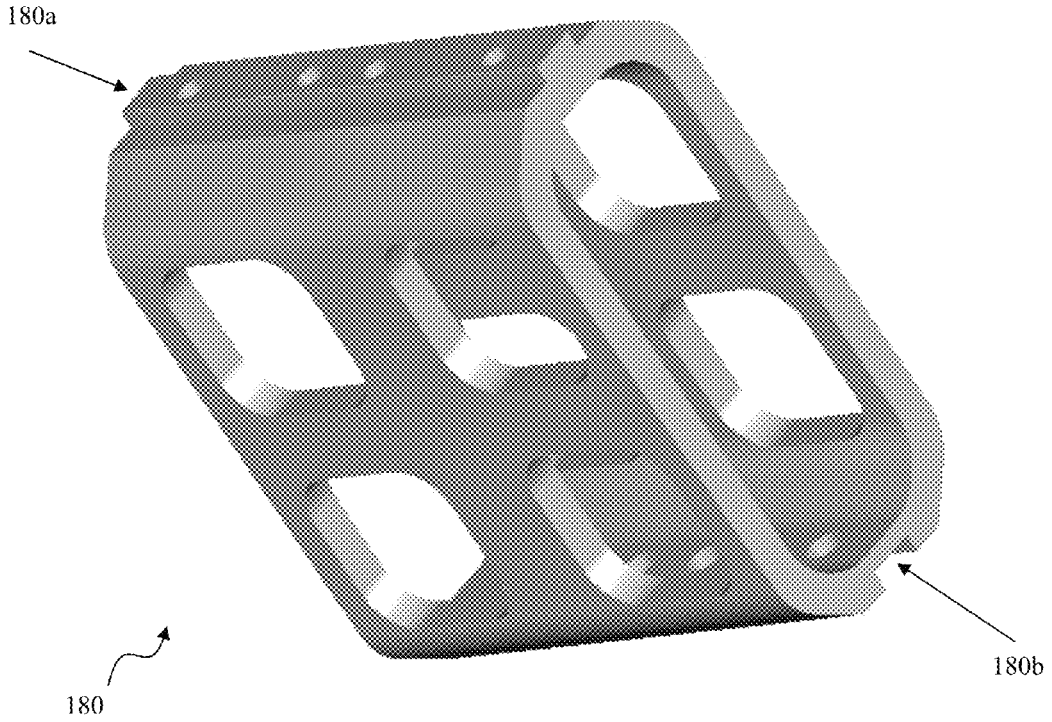
FIG. 6 shows an isometric view of the riser mount-center.
Figure 7:
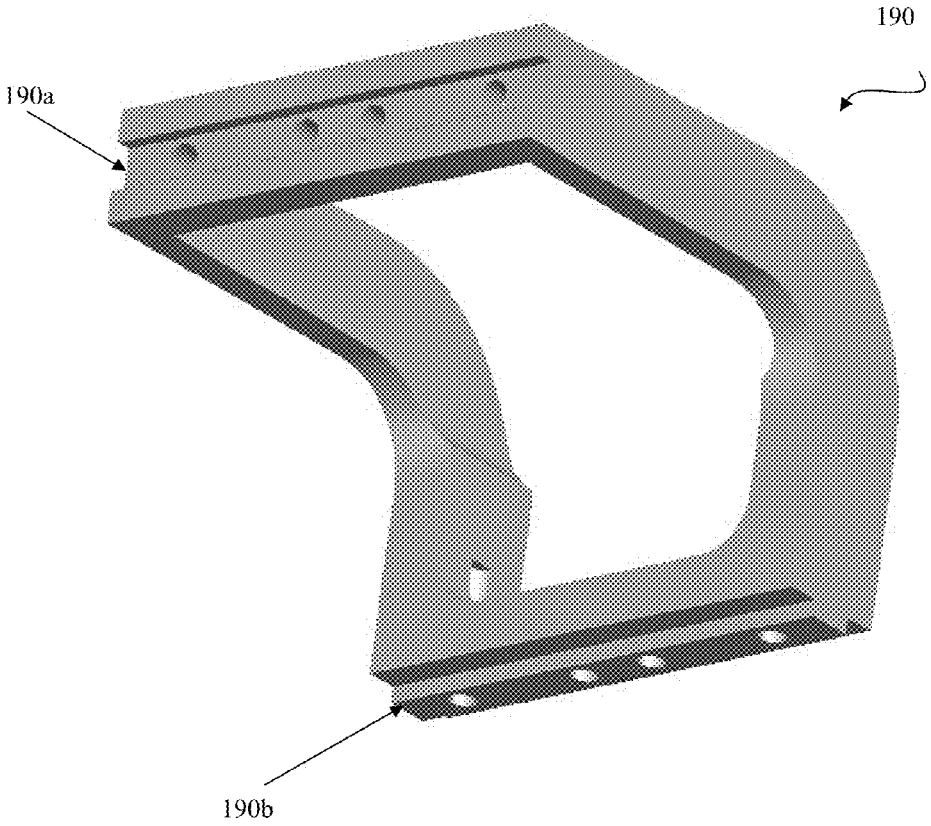
FIG. 7 shows an isometric view of the riser mount-side.
Figure 8:
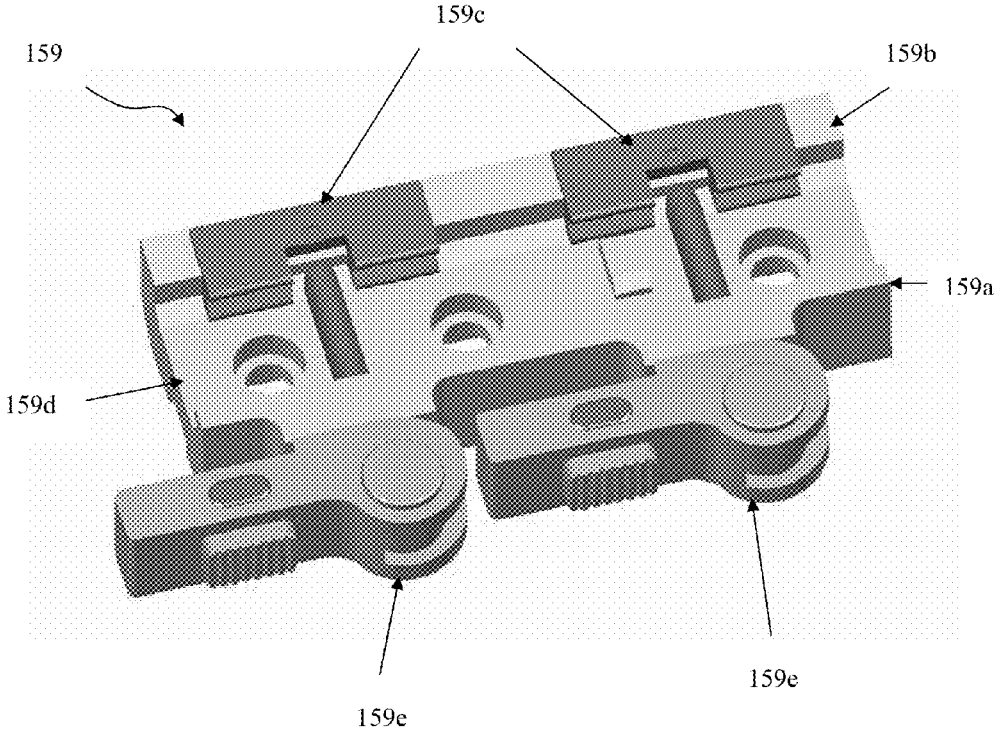
FIG. 8 shows an isometric view of the dual throw lever mount (top).
Figure 10:
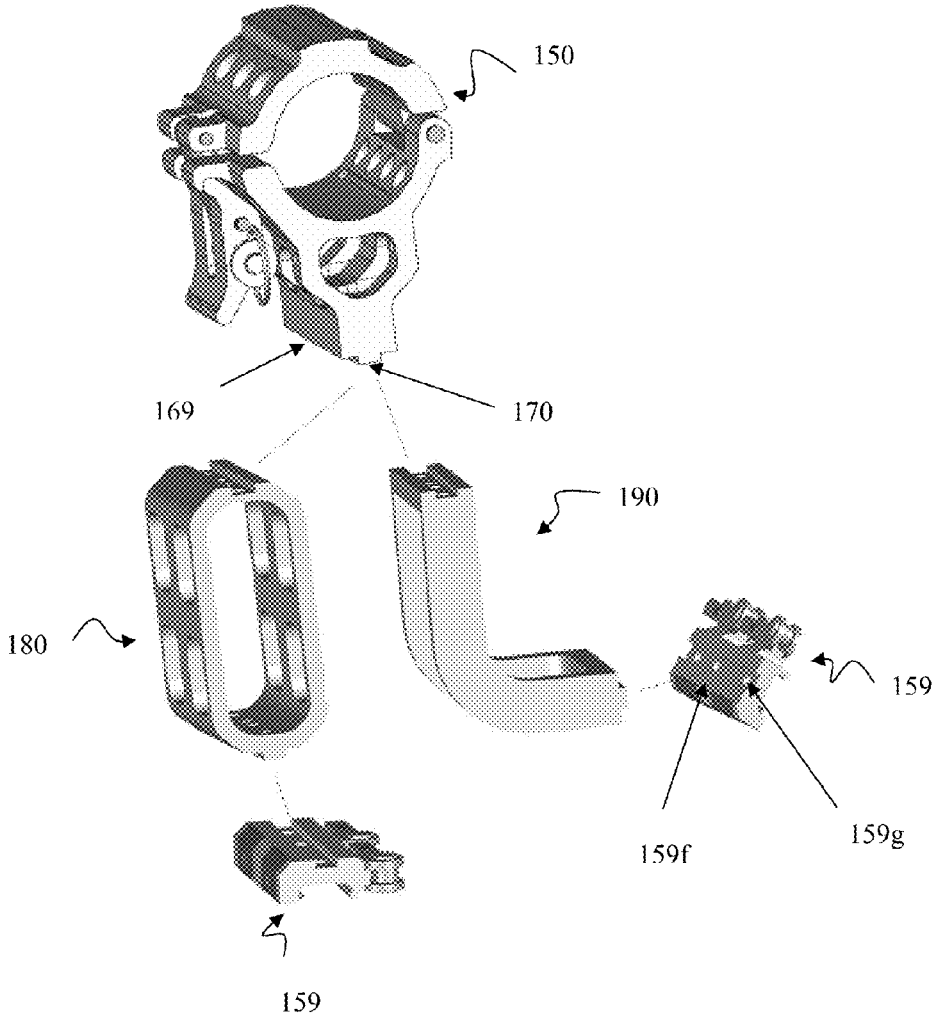
FIG. 10 shows an exploded view of the light mount, including the riser mount-center, riser mount-side and dual-throw lever base mount.

FIG. 6 shows a riser mount-center 180. The riser mount-center contains a central longitudinally oriented raised mounting structure 180*a* on a first end and a central longitudinally oriented grooved accepting structure 180*b* on a second end. FIG. 7 shows a riser mount-side 190. The riser mount-side also contains a central longitudinally oriented raised mounting structure 190*b* on a first end and a central longitudinally oriented grooved accepting structure 190*a* on a second end. FIG. 8 shows a top view of a dual-throw lever base mount 159. The bottom of the dual-throw lever base mount 159 comprises a central longitudinally oriented grooved accepting structure 159*g* (FIG. 10). The top side of the dual-throw lever base mount 159 comprises a central longitudinally oriented groove 159*d* along its length, where one side 159*a* has a rigid beveled edge along its entire length and the other side 159*b* has two moveable bevel-edged assemblies 154*c*. The moveable bevel-edged assemblies 159*c* are mechanically actuated by levers 159*e*, which move the bevel-edged assemblies toward (locked position) or away (open position) from the central groove 159*d*.

Figure 9:
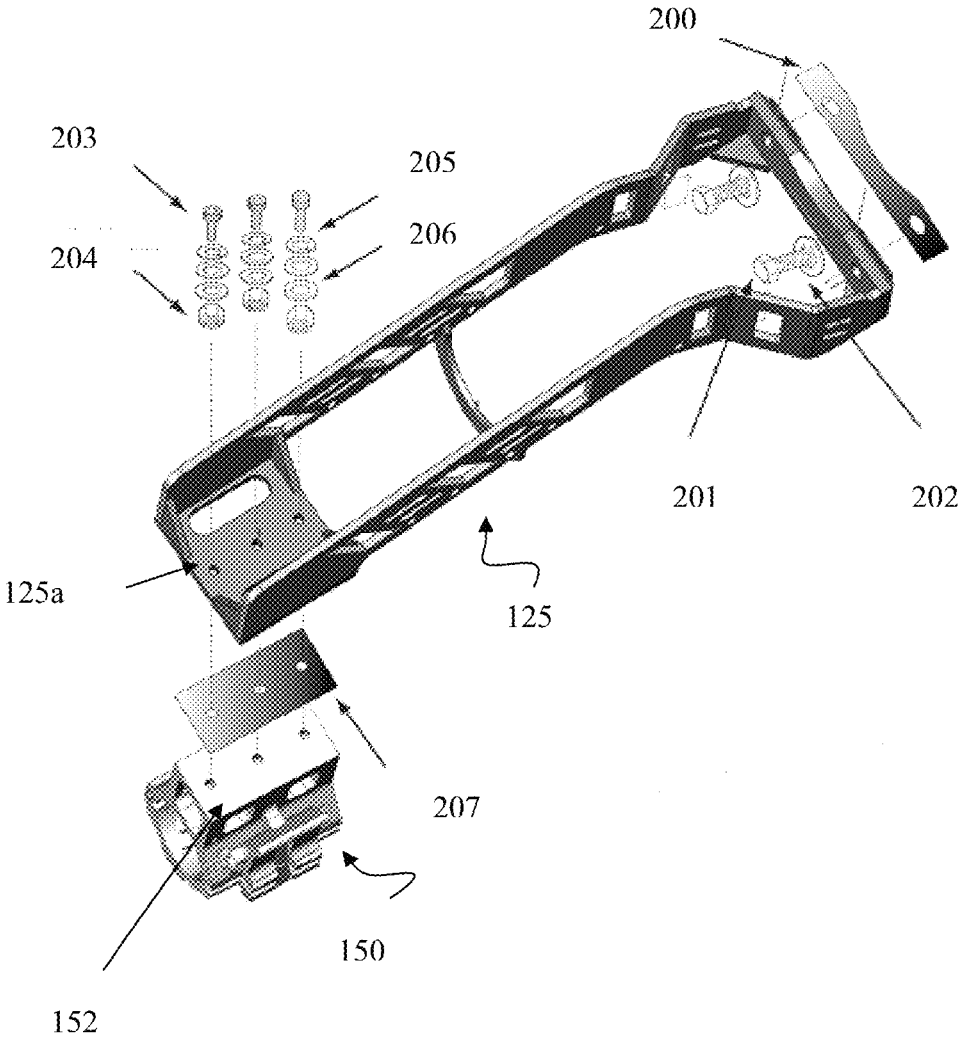
FIG. 9 shows an exploded view of the cantilever mount and light mount, including vibration buffers.

FIG. 9 shows how the light mount 150 and cantilever may be assembled using vibration buffers 200,207. In this figure, the base assembly 152 has a substantially flat bottom surface. A vibration buffer 207 may be disposed between the base assembly 152 of the light mount 150 and a portion 125*a* of the cantilever mount 125. The light mount 150 and vibration buffer 207 may be secured to the cantilever mount 125, for example, using a combination of socket head cap screws 203, nuts 204, and washers 205,206, or the like, as will be readily apparent to one of skill in the art. Further, a second vibration buffer 200 may be disposed at the end of the cantilever mount 125 which engages the two parallel shock buffers 145 (FIG. 2) within the MK93 cradle (i.e., the vibration/shock portion of the gun mounting system 105; FIG. 1). The vibration buffer 200 may be secured between the end of the cantilever 125 and the vibration/shock isolation portion of the gun mounting system 105 (see FIG. 1), for example, using a combination of bolts 201 and flat washers 202 or the like, as will be apparent to one of skill in the art.

FIG. 10 shows how the substantially tubular light mount 150 may be accessorized using, for example, a riser mount-center 180 or riser mount-side 190. As shown in the figure, the riser mounts 180,190 are connected to the base assembly 152 at the substantially flat bottom surface 169 of the light assembly 150 through engagement along the central longitudinally oriented raised mounting structure 170 with the central grooves 180*b*,190*a* (FIGS. 6 and 7, respectively) of the riser mounts 180,190. The dual-throw lever base mount 159 can then be connected to the risers 180,190 through the bottom groove accepting structure 159*g* of the dual-throw lever base mount 159 and the central longitudinally oriented raised mounting structure 180*a*,190*b* (FIGS. 6 and 7, respectively) of the riser mounts 180,190. The riser mounts 180,190 and dual-throw lever base mount 159 may be secured using, for example, socket head cap screws 162*b* (FIG. 4) or low profile socket head cap screws or the like, as will be readily apparent to one of skill in the art. Such accessorized light mounts may be connected to the cantilever mount 125, for example, through the dual-throw lever base mount 159 attached to the riser mounts 180,190, leaving the rail 153 attached to the base assembly 152 available for connecting separate accessories. Alternatively, the accessorized light mounts may be connected to the cantilever mount 125, for example, through the rail 153 attached to the base assembly 152, leaving the dual-throw lever base mount 159 attached to the riser mounts 180,190 available for connecting separate accessories.

In an alternative embodiment, the bottom surface of the base assembly 152 has a central longitudinally oriented raised mounting structure thereon (170, FIG. 4). When using the alternative base assembly 152, the portion 125*a* of the cantilever mount 125 which attaches to the light mount 150 possesses a bottom surface configured to accept the mounting structure 170 (FIG. 4) of the base assembly 152. For example, the portion 125*a* of the cantilever mount 125 will have a bottom surface comprising a central longitudinally oriented grooved accepting structure or the like.

Figure 11:
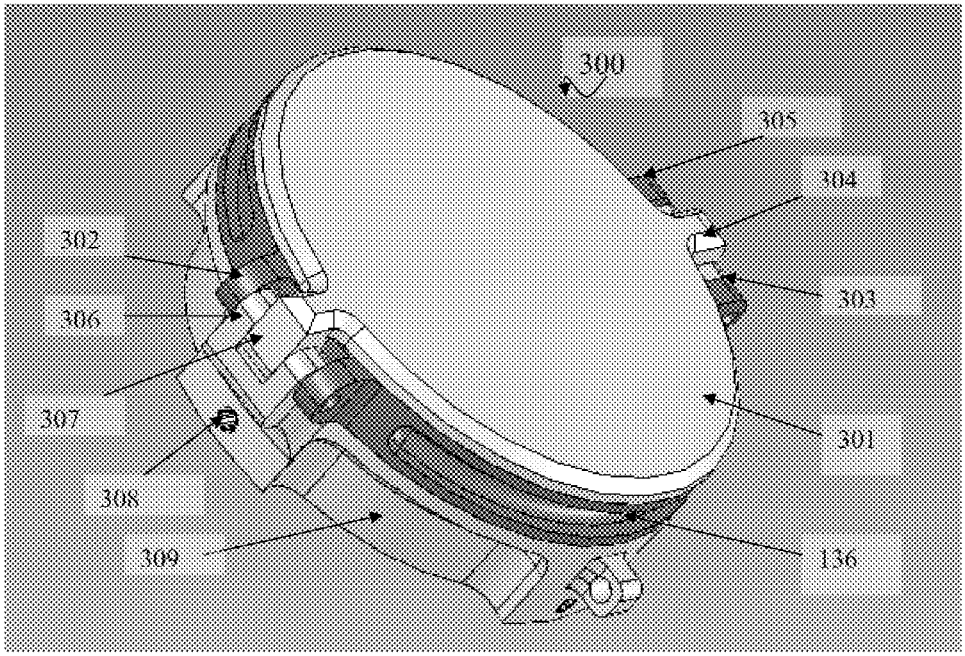
FIG. 11 shows a perspective view (top) of the cover assembly.
Figure 12:
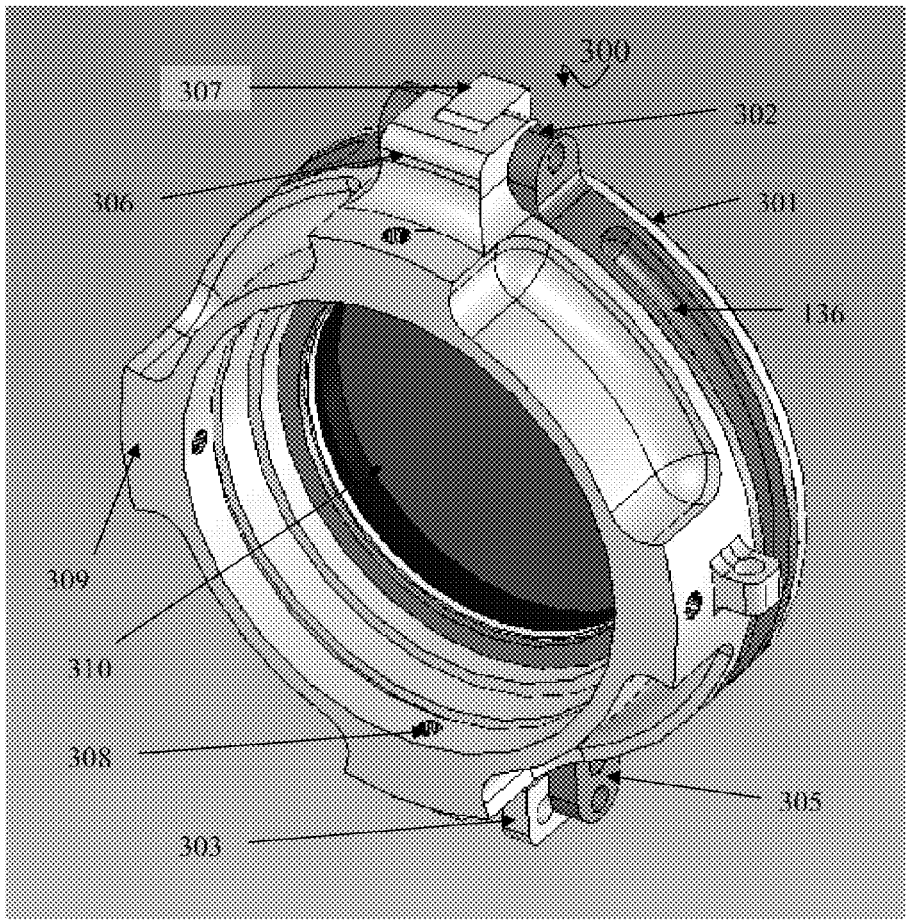
FIG. 12 shows an alternate perspective view (bottom) of the cover assembly.
Figure 13:
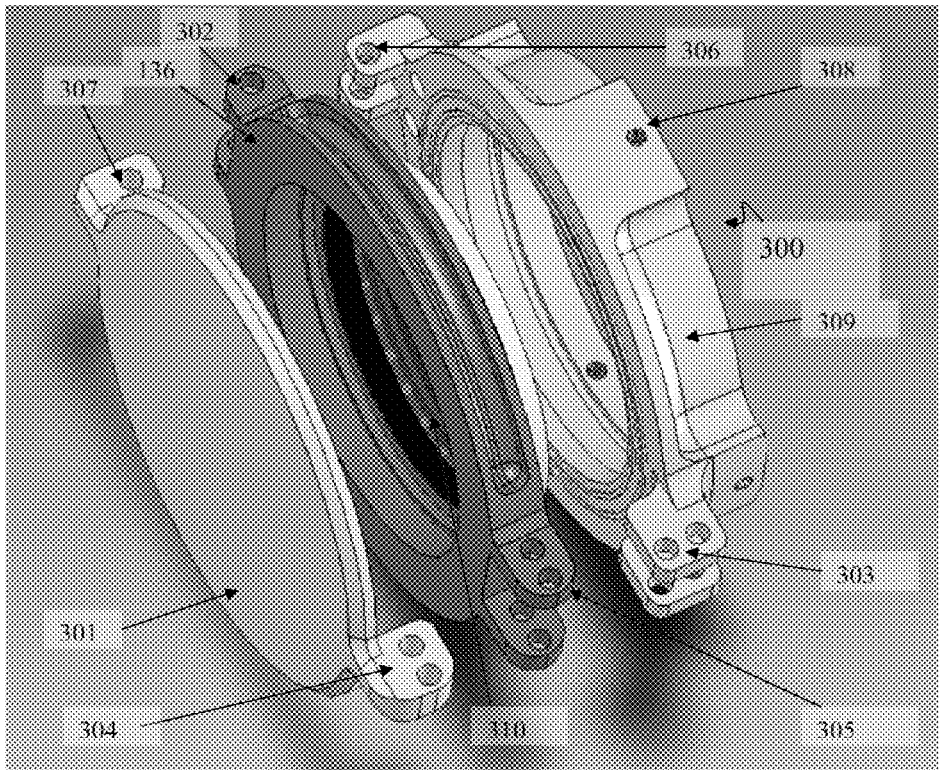
FIG. 13 shows an exploded view of the cover assembly.

FIGS. 11 and 12 show perspective views of a cover assembly 300. FIG. 13 shows an exploded view of the cover assembly 300. In one aspect, the cover assembly 300 is mounted at the light-discharging end of the searchlight 135, which cover assembly 300 includes a protective outer lid 301, a separate middle lens-containing frame 136 and a separate base 309, where the lid 301, lens frame 136 and base 309 are hingedly connected by a bolt or the like. The separate base 309 is adapted to engage said light-discharging end of the searchlight 135, and may be anchored to the light-discharging end of the searchlight 135 by, for example, low profile socket head cap screws through holes 308 disposed at the periphery of the base 309. Alternatively, the base 309 may be secured to the searchlight 135 by helically threaded engagement.

The lid 301 and frame 136 are adapted to separately pivot to and away from the base 309 through a first hinge (i.e., combination of 303,304,305). In one aspect, the lens 310 may be protected by securing the lid 301 against the lens frame 132 via one or more magnets. Further, the lid 301 or lens frame 136 may be separately secured to or away from the base 309 via one or more push-pull pins 137 anchored through a second hinge (i.e., combination of 302,306,307). The outer lid 301 serves as a shield that protects the lens 310 (e.g., IR filter glass) when the searchlight 135 is not going to be used. The lid 301 folds out of the way when the operator needs IR or other filtered light. The frame 136 can be folded out of the way to reveal the white light mode (see also, FIG. 3).

In one aspect, frame 136 itself uses a light tight seal design and utilizes natural magnets to initially secure a closed assembly 300 (FIG. 11 and FIG. 12). The cover assembly 300 may be double locked using up to 2 push-pull pins 137 to secure the layers in any mode. In another aspect, the cover assembly 300 may be made of heavy gauge steel, magnesium, zinc, aluminum, rubberized aluminum, polycarbonate, a rugged plastic material, or the like.

In another embodiment, a method of attaching the searchlight system to a MK93 gun mounting system includes removing high strength bolts that secure two parallel shock buffers within the MK93 gun mounting system, inserting the high strength bolts through holes at one end of a cantilever mount of the searchlight system, attaching the high strength bolts back to the two parallel shock buffers and securing the cantilever mount of the searchlight system to the MK93 gun mounting system or the like. The method may further include attaching a light mount near an end of the cantilever mount (opposite the MK93 gun mounting system) and removably attaching a searchlight to the light mount.

The method may also include disposing one or more vibration shock buffers between one end of the cantilever mount and the vibration/shock isolation portion of the gun mounting system and disposing one or more vibration buffers between another end of the cantilever and the light mount. Moreover, the method may include locking down a toggle clamp assembly configured to engage a top assembly and a base assembly that form the substantially tubular light mount, such that when the toggle clamp assembly comprises a push-pull pin and the toggle clamp assembly is locked down and engaged, the searchlight is removably secured within the light mount.

Having now set forth the embodiments above and certain modifications of the concept underlying the present invention, various other embodiments as well as certain variations and modifications of the embodiments herein shown and described will occur to those skilled in the art upon becoming familiar with said underlying concepts, including that such modifications and variations are encompassed within the spirit and scope of the invention.

All references cited herein are incorporated by reference in their entirety.

We claim herein:

1. A searchlight system comprising:

a cantilever mount having a first end configured to attach to a vibration/shock isolation portion of a gun mounting system, wherein the cantilever mount comprises at least one bend therein defining a reflex angle relative to the longitudinal plane of said vibration/shock isolation portion;

a substantially tubular light mount configured to attach near a second end of the cantilever mount; and a searchlight removably attached within a cavity formed inside the substantially tubular light mount, wherein the cavity is formed by a top assembly hingedly connected to a base assembly, whereby said top assembly and base assembly encircle said searchlight.

2. The searchlight system of claim 1, wherein an outside surface of the substantially tubular light mount comprises a toggle latch-clamp assembly configured to oppose a hinged connection between said top assembly and said base assembly.

3. The searchlight system of claim 2, wherein the toggle-latch clamp assembly comprises a push-pull pin engaged therein configured to securely clasp said searchlight.

4. The searchlight system of claim 1, wherein an outer surface of said top assembly comprises at least one rail affixed along an apex substantially orthogonal relative to a hinged connection.

5. The searchlight system of claim 1, wherein the base assembly comprises an integral block portion having a substantially flat top surface or having a substantially flat top surface and a central longitudinally oriented raised mounting structure thereon configured to engage an accessory or said cantilever mount.

6. The searchlight system of claim 5, wherein said raised mounting structure is coupled to a rail grabber assembly or a dual-throw lever base mount.

7. The searchlight system of claim 5, wherein the accessory comprises at least one riser mount coupled at a first end to the raised mounting structure.

8. The searchlight system of claim 7, wherein the riser mount is a riser mount-center or a riser mount-side.

9. The searchlight system of claim 7, wherein a rail grabber assembly or a dual-throw lever base mount is coupled to a second end of said at least one riser mount.

10. The searchlight system of claim 7, wherein the second end of said cantilever mount is coupled to a second end of said at least one riser mount.

11. The searchlight system of claim 1, wherein a portion of the second end of said cantilever mount has a substantially flat bottom surface configured to engage the base assembly of the substantially tubular light mount or has a substantially flat bottom surface and a central longitudinally oriented raised mounting structure thereon configured to engage an accessory.

12. The searchlight system of claim 1, wherein the gun mounting system is a MK93 gun mounting system.

13. The searchlight system of claim 1, wherein the searchlight is a high intensity discharge searchlight.

14. The searchlight system of claim 13, wherein said searchlight comprises a substantially circular cover assembly at a light-discharging end of said searchlight, which cover assembly comprises, in hinged connection, a protective outer lid, a separate middle lens-containing frame and a separate base, wherein said separate base is adapted to engage said light-discharging end, and wherein said lid and middle frame are adapted to separately pivot to and away from said base through a first hinge.

15. The searchlight system of claim 14, wherein the lens is IR filter glass.

16. The searchlight system of claim 14, wherein said lens is protected by securing the lid against the middle frame via one or more magnets.

17. The searchlight system of claim 14, wherein said lid or middle frame is separately secured to or away from the base via one or more push-pull pins anchored through a second hinge.

* * * * *